US006879333B2

(12) United States Patent
Furuyama

(10) Patent No.: US 6,879,333 B2
(45) Date of Patent: Apr. 12, 2005

(54) RESISTIVE RIBBON THERMAL PRINT HEAD AND PRINTER USING THE SAME

(75) Inventor: Shinichi Furuyama, Tokyo (JP)

(73) Assignee: Osamu Majima, Tokyo (JP)

( * ) Notice: Subject to any disclaimer, the term of this patent is extended or adjusted under 35 U.S.C. 154(b) by 169 days.

(21) Appl. No.: 10/291,747

(22) Filed: Nov. 12, 2002

(65) Prior Publication Data

US 2004/0135870 A1 Jul. 15, 2004

(51) Int. Cl.[7] ..... B41J 2/335
(52) U.S. Cl. ..... 347/208
(58) Field of Search ..... 347/208, 213, 347/219, 171–173, 176; 400/120.01, 120.02, 120.04, 120.16

(56) References Cited

U.S. PATENT DOCUMENTS 5,708,467 A * 1/1998 Yoshikawa et al. ..... 347/213

6,195,112 B1 * 2/2001 Fassler et al. ..... 347/219

* cited by examiner

*Primary Examiner*—K. Feggins
(74) *Attorney, Agent, or Firm*—Pillsbury Winthrop LLP

(57) ABSTRACT

An electro-thermosensitive transfer printer is provided with a gravure endless ribbon including a conductive thin film belt having a large number of gravure cells on its right side and an electric resistor layer laminated on its back side; and a resistive ribbon thermal print head including an electric insulating plate body coming into contact with the surface of the electric resistor layer, a heat-radiating plate embedded in the plate body, sliding along the surface of the electric resistor layer, and a large number of signal electrodes embedded in the plate body, sliding along the surface of the electric resistor layer. The signal electrodes are arrayed so that each of them is opposite to each of the gravure cells.

18 Claims, 11 Drawing Sheets

RESISTIVE RIBBON THERMAL PRINT HEAD AND PRINTER USING THE SAME

BACKGROUND OF THE INVENTION

1. Field of the Invention

This invention relates to a novel, electro-thermosensitive transfer printer in which wax ink, or resin ink equivalent thereto, is transferred as dots of various sizes onto the surface of a blanket roller or a blanket belt and thereby images are printed, and a resistive ribbon thermal print head applicable to this printer.

2. Description of Related Art

By the advancements of computers and communication apparatuses, various printers using common and special paper, such as thermal transfer printers, ink jet printers, and electrophotographic printers (lasers, LEDs, and liquid crystals), are developed and are now commercially available.

The thermal transfer printer has the problem that the efficiency of utilization of the ink ribbon is extremely impaired and many ink ribbons are consumed for the amount of printing. Additionally, in a thermal adhesive printer, multi-tone production is difficult because of the characteristics of a printing head and pigment wax ink. In contrast to this, a sublimation dye transfer printer is suitable for multi-tone production, but uses particular exclusive dye (disperse dye) and thus has the problems that not only does it require special paper usable for the dye as matter to be printed, but also the dye is liable to fade.

The ink jet printer requires printing paper such that ink droplets are not scattered and are effectively absorbed and a particular coating is applied in order to obtain a good image. Furthermore, this printer has the problem that in order to prevent the occurrence of nozzle clogging and kogation (burning of the head), dye must be used in which a color substance do not contain solid matter or even though the solid matter is contained, its size is less than 1 $\mu$m. In particular, for a bubble jet printer, even when dye ink is used, kogation (burning of the head) is liable to occur in the printing head, and therefore, at present, used printing heads are disposed as waste together with color substance tanks.

In the electrophotographic printer, a photosensitive drum unit and a development unit are integrally constructed, and used ones are disposed as waste together with residual toner and photoreceptors, with a resulting increase in running cost. In particular, for electronic photographs of liquid development, the recovery and disposal of vapor produced in fixing and drying of a petroleum-based organic solvent used for scattering of toner and the disposal of other remainders pose major pollution problems.

SUMMARY OF THE INVENTION

It is, therefore, a primary object of the present invention to provide an electro-thermosensitive transfer printer in which very fine letters and sharp full-color images can be printed at a high speed and at a low cost.

It is another object of the present invention to provide an electro-thermosensitive transfer printer which is entirely free of waste and is capable of using nearly all commercially-available hard copy media to be printed.

It is still another object of the present invention to provide an electro-thermosensitive transfer printer which is small in size and low in cost.

It is a further object of the present invention to provide a print head suitable for the electro-thermosensitive transfer printer.

In order to achieve the above objects, the print head for the electro-thermosensitive transfer printer according to the present invention comprises an electric insulating body having a top face to come into contact with the surface of an electric resistor layer of a gravure endless ribbon which includes a conductive thin film belt having a large number of partition walls arrayed in a lattice manner on the surface thereof in order to define a large number of gravure cells of predetermined size and the electric resistor layer laminated on the back side of the conductive thin film belt; a heat-radiating plate embedded in the body so that its top surface is capable of sliding along the surface of the resistor layer, having a thickness corresponding to that of each of the partition walls; and a large number of signal electrodes embedded in the body so that each of their top faces is spaced from the heat-radiating plate by nearly half of the size of each gravure cell and is opposite thereto to slide along the surface of the resistor layer. The signal -electrodes are arrayed to be opposite to the gravure cells in front of the heat-radiating plate with respect to the running direction of the gravure endless ribbon.

The resistive ribbon thermal print head for the electro-thermosensitive transfer printer according to the present invention comprises an electric insulating body having a top face to come into contact with the surface of a first conductive film of a gravure endless ribbon which includes a heat-resistant polymer resin thin film belt having a large number of partition walls arrayed in a lattice manner on the surface thereof in order to define a large number of gravure cells of predetermined size, a base electrode layer evaporated on the back side of the thin film belt, the first conductive film provided on the base electrode layer, and a second conductive film provided on the right side of the thin film belt; a heat-radiating plate embedded in the body so that its top surface is capable of sliding along the surface of the first conductive film, having a thickness corresponding to that of each of the partition walls; and a large number of signal electrodes embedded in the body so that each of their top faces is spaced from the heat-radiating plate by nearly half of the size of each gravure cell and is opposite thereto to slide along the surface of the first conductive film. The signal electrodes are arranged to be opposite to the gravure cells in the direction of run of the gravure endless ribbon in front of the heat-radiating plate.

According to the present invention, the electric insulating body is made of resin of low frictional resistance, poor heat conductivity, and good electric insulation, such as polytetrafluoroethylene, polyethylene, polyacetals, or polypropylene, or ceramic. The heat-radiating plate is made of metal of good heat conductivity, such as copper, aluminum, or silver, or diamond or ceramic equivalent thereto. The signal electrodes are made of metal, such as tungsten or tantalum.

The electro-thermosensitive transfer printer according to the present invention comprises an ink tank having a heating device; an ink supply roller partially immersed in the ink tank and rotated; a pair of tension rollers, a press roller, and a sprocket, arranged at prescribed intervals; a thermal transfer film tightened to be able to run via the pair of tension rollers, the press roller, and the sprocket so that its right side comes into contact with the ink supply roller, or a gravure endless ribbon of a predetermined width, having an electric resistor layer on the back side of a conductive thin film belt which is provided with a large number of gravure cells arrayed in a lattice manner on the right side; a first cooling fan placed in the proximity of the thermal transfer film or the gravure endless ribbon, or a first cooling roller laterally mounted to rotate into contact with the back side of the thermal transfer film or the gravure endless ribbon; a resistive ribbon thermal print head interposed between the press roller and the sprocket so that top faces of a heat-radiating plate and a large number of signal electrodes slide along the back side of the thermal transfer film or the gravure endless ribbon; a blanket roller laterally mounted to rotate into contact with the gravure endless ribbon put between the blanket roller and the print head and between the blanket roller and the press roller; a transfer roller (impression cylinder) laterally mounted to rotate into contact with matter to be printed, put between the transfer roller and the blanket roller; a heater laterally mounted close to the blanket roller in front of the blanket roller; and a second cooling fan placed close to the blanket roller behind the blanket roller, or a second cooling roller laterally mounted to rotate into contact with the blanket roller. The first and second cooling rollers are constructed with heat pipes.

The electro-thermosensitive transfer printer according to the present invention further comprises a heater laterally mounted in the proximity of the back side of the gravure endless ribbon between the pair of tension rollers; a doctor blade laterally mounted so as to come into contact with the right side of the gravure endless ribbon behind the ink supply roller; and a cleaning roller laterally mounted so that a nonwoven fabric belt runs into contact with the blanket roller between the transfer roller (impression cylinder) and the second cooling fan or the second cooling roller.

The electro-thermosensitive transfer printer according to the present invention comprises an ink tank; an ink supply roller partially immersed in the ink tank and rotated; a pair of tension rollers, a press roller, and a sprocket, arranged at prescribed intervals; a gravure endless ribbon of a predetermined width tightened to be able to run via the pair of tension rollers, the press roller, and the sprocket so that its right side comes into contact with the ink supply roller, having an electric resistor layer on the back side of a conductive thin film belt which is provided with a large number of gravure cells arrayed in a lattice manner on the right side; a first cooling roller laterally mounted to rotate into contact with the back side of the gravure endless ribbon, or a cooling fan placed in the proximity of the back side of the gravure endless ribbon; a thermal print head interposed between the press roller and the sprocket to slide along the back side of the gravure endless ribbon, or a resistive ribbon thermal print head provided so that top faces of a heat-radiating plate and a large number of signal electrodes slide along the back side of the gravure endless ribbon; a platen roller laterally mounted to rotate into contact with the thermal print head or the resistive ribbon thermal print head; a receiving roller laterally mounted to be rotatable in parallel with the platen roller; a blanket endless belt put via the receiving roller and the platen roller so as to maintain predetermined tension and run so as to press the surface of the gravure endless ribbon put between the blanket endless belt and the thermal print head or the resistive ribbon thermal print head; a transfer roller (impression cylinder) laterally mounted to rotate into contact with matter to be printed, put between the transfer roller and the blanket endless belt; a heater laterally mounted close to the blanket endless belt in front of the transfer roller (impression cylinder); and a second cooling roller laterally mounted to rotate into contact with the blanket endless belt behind the transfer roller (impression cylinder), or a second cooling fan laterally mounted close to the surface of the gravure endless ribbon. The first and second cooling rollers are constructed with heat pipes.

The electro-thermosensitive transfer printer according to the present invention further comprises a second press roller provided between the pair of tension rollers to press the surface of the gravure endless ribbon against the ink supply roller; a doctor blade laterally mounted so as to come into contact with the surface of the gravure endless ribbon behind the ink supply roller; and a cleaning blade laterally mounted so as to slide along the surface of the blanket endless ribbon between the transfer roller (impression cylinder) and the second cooling roller or cooling fan and a cleaning roller laterally mounted so as to run a nonwoven fabric belt into contact with the surface of the blanket endless belt.

The electro-thermosensitive transfer printer according to the present invention further comprises a memory means detecting an electric resistance value between each gravure cell and the corresponding signal electrode, with each of a large number of signal electrodes as a probe, to record the resistance value and the address of the gravure cell; and a control means calculating electric energy to be supplied to each signal electrode from image data, the address of the gravure cell recorded in the memory means, and the corresponding resistance value during the run of the gravure endless ribbon.

According to the present invention, ink stored in the ink tank is changed into lipophilic wax ink, and the matter to be printed can be used as an offset printing master whose surface to be printed becomes rough.

The electro-thermosensitive transfer printer according to the present invention comprises a plurality of thermal transfer film units or gravure endless ribbon units which include pairs of tension rollers nearly horizontally arranged to be rotatable at prescribed intervals; a receiving roller rotatably placed between a pair of tension rollers arranged on one end side; a transfer roller (impression cylinder) placed to rotate into contact with the receiving roller; a plurality of platen rollers arranged on a nearly the same horizontal plane to be rotatable at prescribed intervals between the pair of tension rollers arranged on one end side and a pair of tension rollers arranged on the other end side; a blanket endless belt tightened by the tension rollers, the receiving roller, and the platen rollers; a heater laterally mounted in the proximity of the surface of the blanket endless belt in front of the receiving roller or the tension rollers; a cleaning blade laterally mounted to slide along the surface of the blanket endless belt behind the receiving roller; and cooling rollers laterally mounted to rotate into contact with the surface of the blanket endless belt behind the platen rollers or cooling fans arranged in the proximity of the surface; and each of which includes an ink tank; an ink supply roller partially immersed in the ink tank and rotated; a pair of tension rollers, a press roller, and a sprocket, arranged at prescribed intervals; a thermal transfer film tightened to be able to run via the pair of tension rollers, the press roller, and the sprocket so that its right side comes into contact with the ink supply roller, or a gravure endless ribbon of a predetermined width, having an electric resistor layer on the back side of a conductive thin film belt which is provided with a large number of gravure cells arrayed in a lattice manner on the right side or a base electrode layer and a conductive film layer on the back side of a heat-resistant polymer resin thin film belt which is provided with a large number of gravure cells arrayed in a lattice manner, with a conductive layer on the right side; a first cooling roller laterally mounted to rotate into contact with the back side of the thermal transfer film or the gravure endless ribbon, or a cooling fan placed in the proximity of the back side; and a thermal print head interposed between the press roller and the sprocket to slide along the back side of the gravure endless ribbon or the thermal transfer film, or a resistive ribbon thermal print head provided so that top faces of a heat-radiating plate and a large number of signal electrodes slide along the back side of the gravure endless ribbon. Each of the thermal transfer film units or each of the gravure endless ribbon units is removably constructed so that the thermal print head or the resistive ribbon thermal print head presses the thermal transfer film or the gravure endless ribbon put between the print head and the platen roller against the platen roller.

According to the present invention, the heat-resistant polymer resin thin film belt is made of aromatic polyamide, polybenzimidazole, fluororesin, or polyimide, the base electrode layer is made of aluminum, and the first and second conductive films are made of diamond-like carbon.

The electro-thermosensitive transfer printer according to the present invention comprises a blanket endless belt unit which include a plurality of platen rollers arranged at prescribed intervals; a receiving roller placed parallel with the platen rollers; a transfer roller (impression cylinder) rotated into contact with the receiving roller; and a blanket endless belt tightened by the plurality of platen rollers and the receiving roller and run between the receiving roller and the transfer roller (impression cylinder); and a plurality of gravure endless ribbon units or thermal transfer film units, each of which includes an ink supply roller; a plurality of second tension rollers; a thermal print head or a resistive ribbon thermal print head; and a gravure endless ribbon or a thermal transfer film tightened by the ink supply roller and the plurality of second tension rollers. Each of the gravure endless ribbon units or each of the thermal transfer film units is removably constructed so that the thermal print head or the resistive ribbon thermal print head presses the gravure endless ribbon or the thermal transfer film put between the print head and the platen roller against the platen roller.

According to the present invention, the plurality of gravure endless ribbon units or thermal transfer film units include a proper combination selected from a unit for cyan only, a unit for magenta only, a unit for yellow only, a unit for black only, and a unit for special color only, such as gold or silver.

The electro-thermosensitive transfer printer according to the present invention further comprises a cleaning roller laterally mounted so that a nonwoven fabric belt runs into contact with the surface of the gravure endless ribbon in front of the cleaning blade, and each gravure endless ribbon unit further includes a press roller pressing the surface of the gravure endless ribbon against the ink supply roller and a heater placed in the proximity of the gravure endless ribbon behind the press roll.

The (electro-)thermosensitive transfer printer according to the present invention comprises a plurality of thermal printer units arranged at prescribed intervals, each having a thermal print head and an ink ribbon pressed against a transfer surface by the thermal print head, along the transfer surface of an intermediate transfer member capable of running, and an impression cylinder placed in front of the thermal printer units, pressing matter to be printed against the transfer surface.

The (electro-)thermosensitive transfer printer according to the present invention is such that a thermal printer unit for cyan only, a thermal printer unit for magenta only, a thermal printer unit for yellow only, a thermal printer unit for black only, and a thermal printer unit for special color only, such as gold or silver, are removably arranged at prescribed intervals along the transfer surface. Also, the intermediate transfer member has the shape of an endless belt or drum.

These and other objects as well as the features and advantages of the present invention will become apparent from the following detailed description of the preferred embodiments when taken in conjunction with the accompanying drawings.

DETAILED DESCRIPTION OF THE PREFERRED EMBODIMENTS

Figure 1:
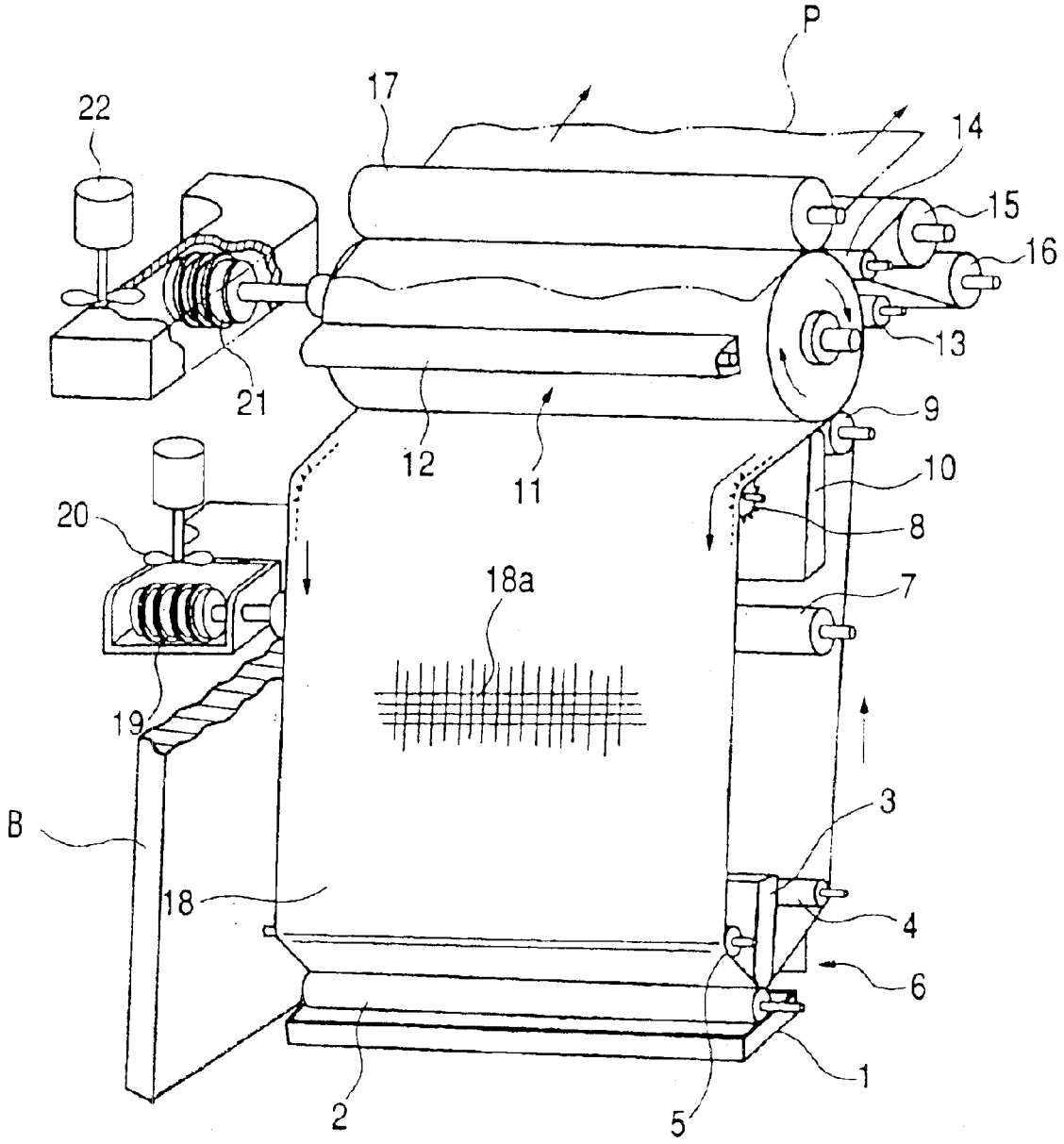
FIG. 1 is a perspective view showing the entire structure of one embodiment of the electro-thermosensitive transfer printer according to the present invention.

In FIG. 1, reference numeral 1 represents an ink tank provided with a proper heating means at the bottom; 2 represents an ink supply roller mounted so that it is partially immersed in resin or wax ink with a low melting point and rotated, stored in a melting state within the ink tank 1; 3 represents a heater head fixed so as to press a gravure endless ribbon for ink feed, which will be described later, against the ink supply roller 2; 4 and 5 represent a pair of parallel tension roller rotatably mounted to an apparatus body B, with the heater head 3 between them; 6 represents a doctor blade; 7 represents a cooling roller to be described later, rotatably mounted to the apparatus body B; 8 represents a sprocket rotatably mounted to the apparatus body B, provided with sprocket wheels at both ends; and 9 represents a press roller for pressing the gravure endless ribbon for ink feed against a blanket roller to be described later.

Reference numeral 10 denotes a resistive ribbon thermal print head to be described later, fixed between the sprocket 8 and the press roller 9; 11 denotes a blanket roller rotatably mounted to the apparatus body B; 12 denotes a heating transfer lamp heater fixed along the width of the blanket roller 11, including a halogen lamp and an elliptical mirror intensively irradiating the surface of the blanket roller 11 with light emitted from the halogen lamp; 13 denotes a cooling roller to be described later, rotatably mounted to the apparatus body B and rotated into contact with the blanket roller 11 at a position opposite to the lamp heater 12 in a nearly radial direction with respect to the blanket roller 11; 14 denotes a cleaning roller rotatably mounted to the apparatus body B and rotated into contact with the blanket roller 11 through nonwoven fabric put between these rollers; 15 denotes an nonwoven fabric roller rotatably mounted to the apparatus body B; 16 denotes an nonwoven fabric winding roller rotatably mounted to the apparatus body B; and 17 denotes a transfer roller rotatably mounted to the apparatus body B and rotated into contact with the blanket roller 11 through matter P to be printed, such as printing paper, sandwiched between these rollers.

Figure 2:
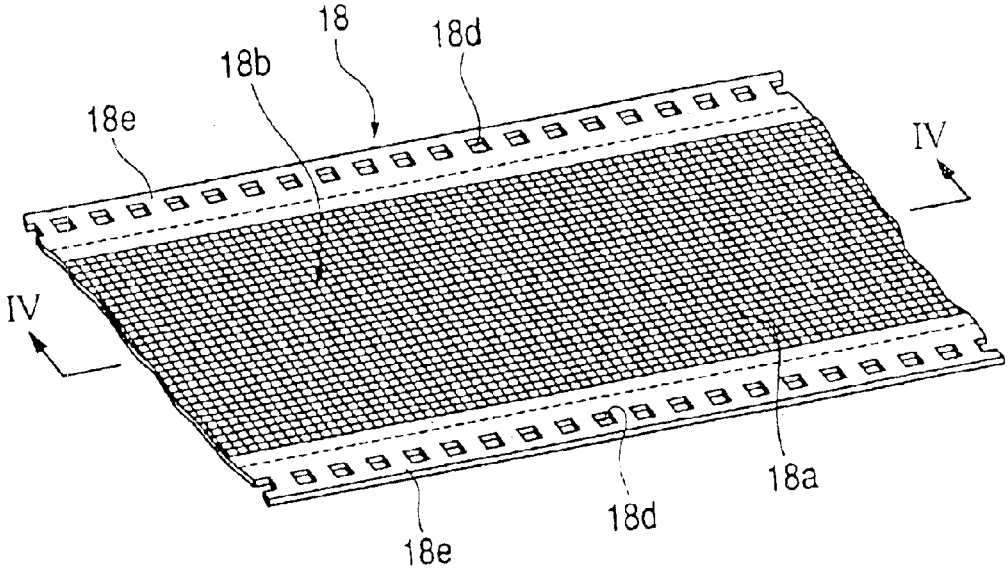
FIG. 2 is a perspective view showing a part of a gravure endless ribbon.
Figure 3:
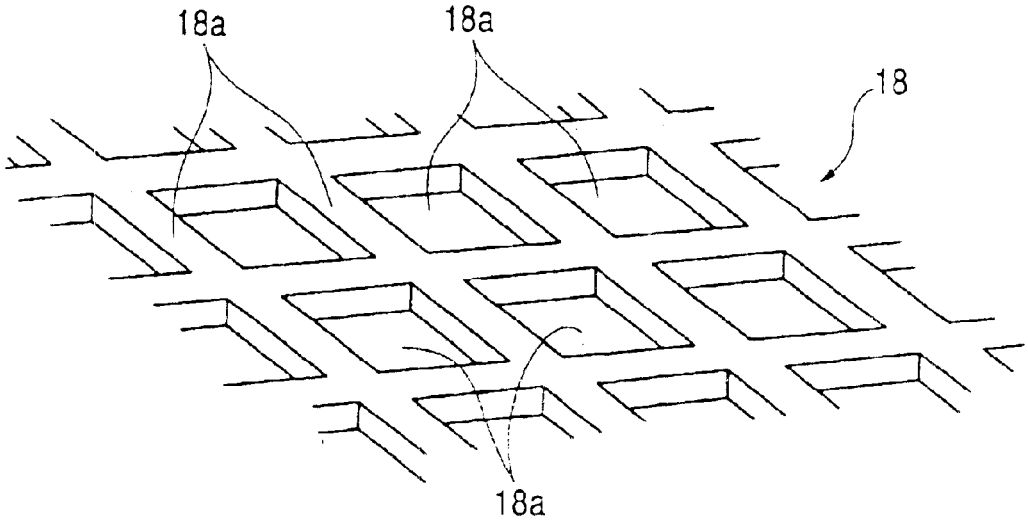
FIG. 3 is an enlarged perspective view showing an array of gravure cells.
Figure 4:
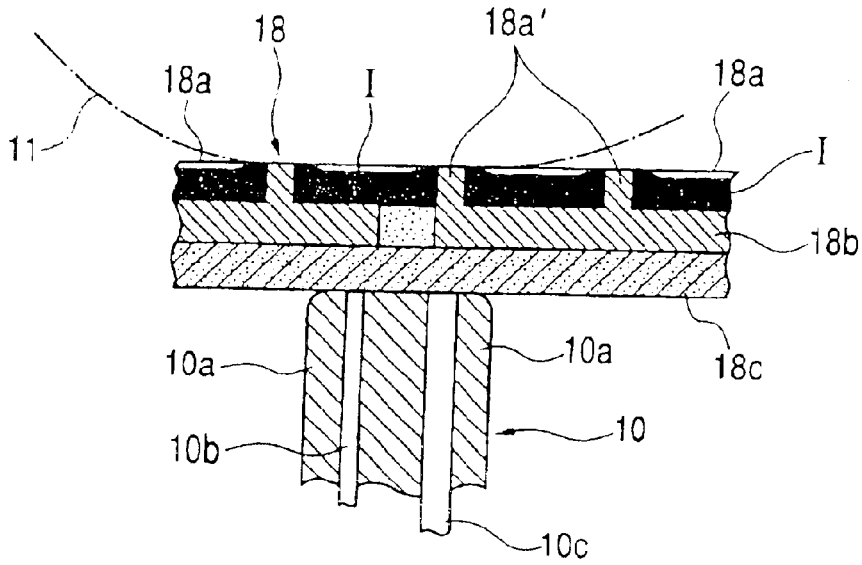
FIG. 4 is a partially enlarged sectional view showing a state of contact between a resistive ribbon thermal print head and the gravure endless ribbon, taken along line IV—IV in FIG. 2.

Reference numeral 18 designates the above-mentioned gravure endless ribbon put on the pair of tension rollers 4 and 5, the press roller 9, and the sprocket 8 so that a state of predetermined tension is maintained, and including a conductive thin film belt 18*b*, as shown in FIGS. 2–4, made of a sheet of metal, such as nickel, which has a large number of gravure cells 18*a* arrayed in a lattice manner at constant intervals; a resistor layer 18*c* made of amorphous silicon, titanium oxide, diamond-like carbon, silicon carbide, tellurium, chromium oxide, or tin oxide, formed on the back surface of the thin film belt 18*b*; and reinforcing belts 18*e* having perforation 18*d* in which holes are provided at prescribed intervals along both edges of the conductive thin film belt 18*b* to engage and disengage the sprocket wheels of the sprocket 8.

The gravure endless ribbon 18 is endlessly run in the direction of an arrow in FIG. 1 by the rotation of the sprocket 8 and passes between the ink supply roller 2 and the heater head 3, between the press roller 9 and the blanket roller 11, and between the print head 10 and the blanket roller 11 so that the ink in the ink tank 1 is carried to the blanket roller 11 by the gravure cells 18*a*.

Again, in FIG. 1, the cooling roller 7 is made with a heat pipe and is rotated into contact with the back surface of the gravure endless ribbon 18, namely the surface of the resistor layer 18*c*, to function so that the ink of the gravure cells 18*a* in a contacting area is cooled and solidified. Here, reference numeral 19 represents a heat sink connected to the cooling roller 7 and 20 represents a cooling fan for cooling the heat sink 19. The cooling roller 13 is also made with the heat pipe and is connected to a heat sink 21. Reference numeral 22 represents a cooling fan for cooling the heat sink 21.

Figure 5:
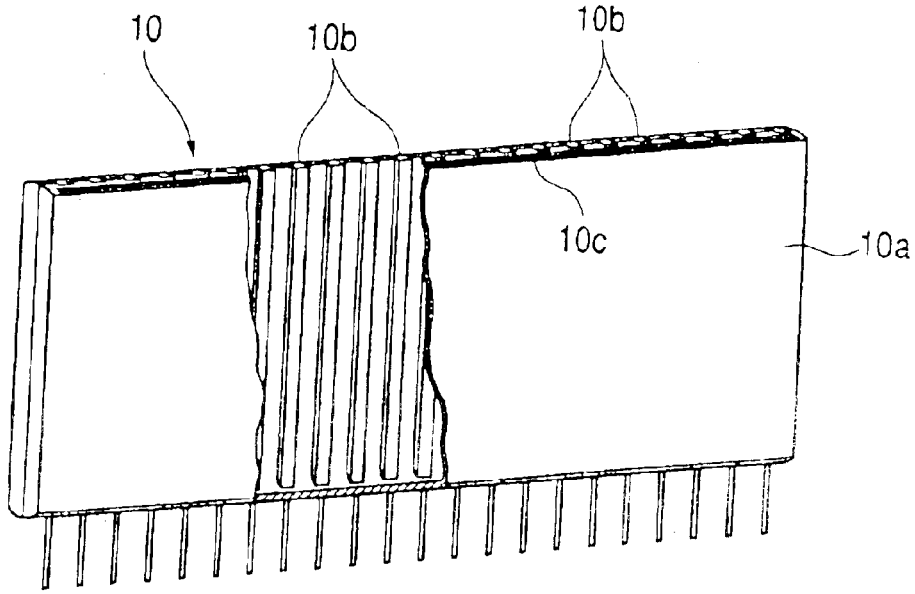
FIG. 5 is a partially cutaway view showing the structure of the print head.

The resistive ribbon thermal print head 10, as clearly shown in FIGS. 4 and 5, is constructed so that electric insulating plates 10*a* which have low friction coefficient and lubricity, made of synthetic resin, such as polytetrafluoroethylene, polyethylene, polyacetals, or polypropylene, or ceramics, are cemented together and thereby a large number of signal electrodes 10*b* made of wear resisting metal, such as tungsten or tantalum, and a heat-radiating plate 10*c* made of good thermal conductive metal, such as copper, aluminum, or silver, or diamond or ceramics having characteristics equivalent thereto are sandwiched between the insulating plates 10*a*. The signal electrodes 10*b* are arrayed at regular intervals corresponding to a series of gravure cells 18*a* arrayed in the direction of the width of the gravure endless ribbon 18. The heat-radiating plate 10*c* is located, as a single plate, at a position such that when the signal electrodes 10*b*, as shown in FIG. 4, are located at the middle of the gravure cell 18*a*, the heat-radiating plate 10*c* is aligned with a gravure cell partition wall 18*a*'. The top surfaces of the signal electrodes 10*b* and the heat-radiating plate 10*c* somewhat protrude from those of the electric insulating plates 10*a* so as to slide along the surface of the resistor layer 18*c* of the gravure endless ribbon 18. The heat-radiating plate 10*c*, whose thickness is chosen to be nearly the same as that of the gravure cell partition wall 18*a*', is constructed so that heat is not transferred from one adjacent gravure cell to the other and heat in the proximity of the gravure cell partition wall 18*a*' can be diffused toward the exterior.

Figure 6:
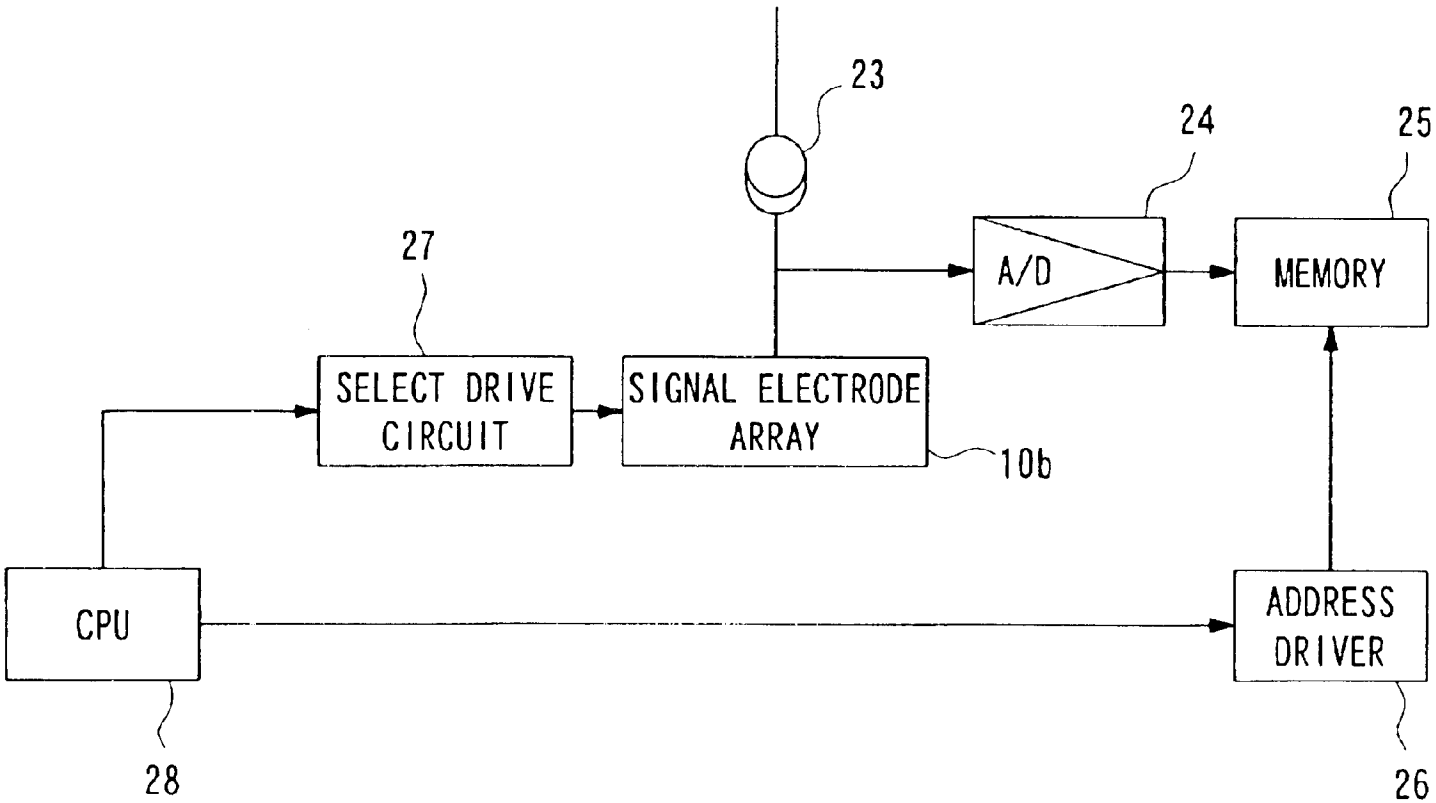
FIG. 6 is a block diagram of an electric control circuit detecting and recording electric resistance between a signal electrode of the print head and a gravure cell.
Figure 7:
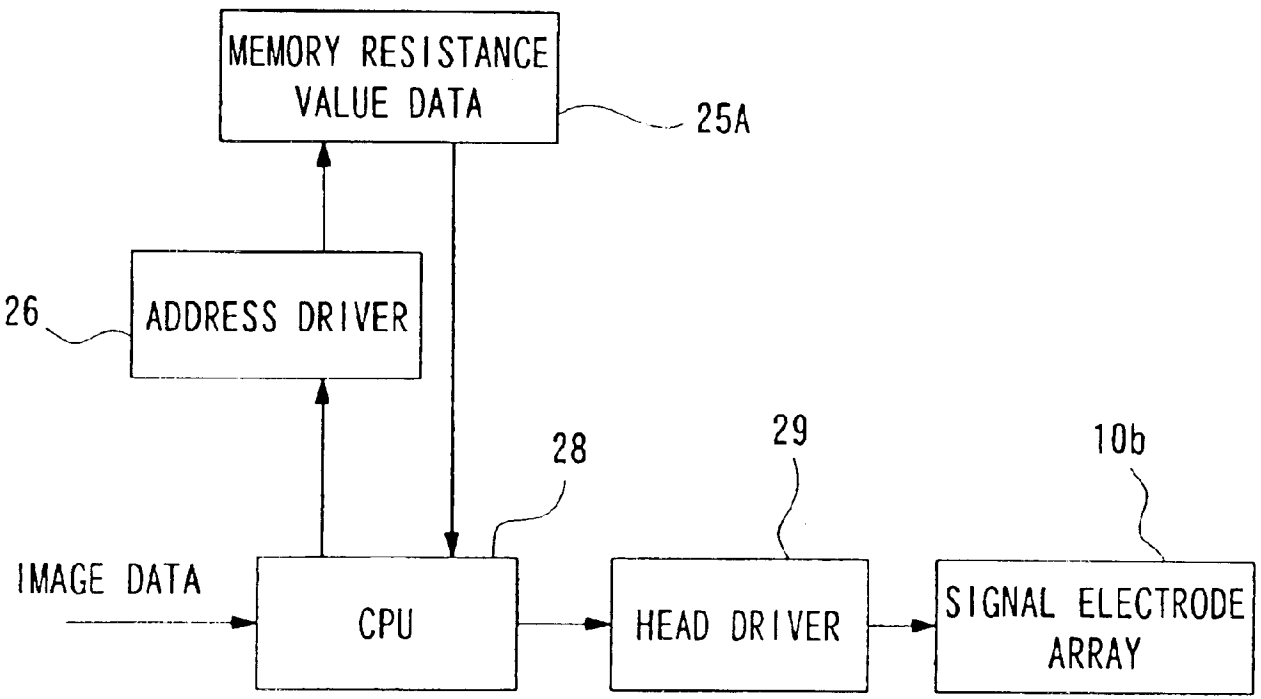
FIG. 7 is a block diagram of an electric circuit for driving the print head.

FIG. 6 shows a probe circuit successively detecting and recording an electric resistance value R between the gravure cell 18*a* and the signal electrode 10*b* corresponding thereto, with a signal electrode as a probe. FIG. 7 shows a head drive circuit operated so that, in view of a resistance value read out from a memory resistance value data 25A, electric energy suitable for an image signal is supplied to the corresponding signal electrode 10*b* through a head driver 29. In these figures, reference numeral 23 denotes a constant-current circuit supplying a constant amount of current to each signal electrode 10*b*; 24 denotes an A/D converter for detecting the electric resistance value between the gravure cell 18*a* and the signal electrode 10*b* corresponding thereto to record the resistance value in a memory 25, together with the address of the signal electrode 10*b*; 26 denotes an address driver for specifying the address; 27 denotes a select drive circuit for bringing each signal electrode 10*b* in succession into an operation condition; and 28 denotes a CPU controlling the operations of the address driver 26 and the select drive circuit 27 and reading out the address of the signal electrode 10*b* and the corresponding resistance value to function so that electric energy to be supplied to the signal electrode 10*b* is calculated from the resistance value and the corresponding image data.

Subsequently, a description is given of the function of the printer. The gravure endless ribbon 18 is run in the direction of the arrow at a constant speed in a state where constant tension is provided in a longitudinal direction by the tension rollers 4 and 5, the sprocket 8, and the press roller 9 and also in the direction of the width by the engagement of the sprocket wheels of the sprocket 8 with the holes of the perforation 18*d*. Hence, by the cooperation of the ink supply roller 2, the heater head 3, and the doctor blade 6, a constant amount of melt ink is charged in each of the gravure cells 18*a* of the gravure endless ribbon 18. In this case, melt ink I charged in each cell, as shown in FIG. 4, is cooled and solidified by the cooling roller 7 in a state where the middle portion of an ink surface in the cell is somewhat concave due to surface tension.

Figure 8:
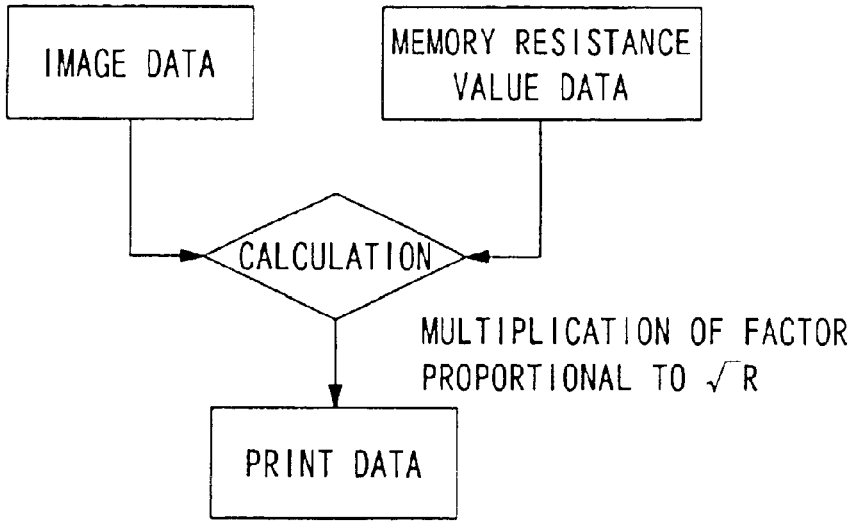
FIG. 8 is a flow chart for obtaining print data from image data and resistance value data.

The ink thus solidified in each cell is sent successively toward the resistive ribbon thermal print head 10 by the run of the gravure endless ribbon 18. Whenever the gravure cells 18*a* arrayed in a row along the width of the gravure endless ribbon 18 correspond to the signal electrodes 10*b*, voltages and currents of magnitudes previously controlled are applied instantaneously to the signal electrodes 10*b*. In this case, since the gravure endless ribbon 18 is a common electrode, current concentration occurs and heat is generated in the resistor layer opposite to the signal electrodes, and energy is provided to the solidified ink of each gravure cell in accordance with the magnitudes of the voltage and current applied to the gravure cell. This energy varies in magnitude with the individual and an ink melting area varies with the amount of energy. In this case, by the function of the head drive circuit shown in FIG. 7, the most suitable voltage is applied to each electrode 10*b* in accordance with print data (see FIG. 8) calculated from corresponding image data or character data and resistance value data between the electrode and the gravure cell, and heat transfer to the adjacent cell is blocked by the heat-radiating plate 10*c*. As such, the ink melting area in each cell can be controlled with a considerable degree of accuracy in accordance with the contrast of the corresponding portion of an original image to be printed.

The amount of the melt ink I corresponding to the ink melting area is thus transferred in a dot manner onto the surface of the blanket roller 11. In this case, the surface layer of the blanket roller 11 is constructed of elastomer such as rubber, and thus sufficiently accommodates the concave produced by the surface tension as indicated by a chain line in FIG. 4 so that the amount of ink corresponding to the ink melting area is faithfully transferred. Ink dots formed on the surface of the blanket roller 11 in this way are solidified once and are melted again by passing the region of the heater 12. Immediately after that, printing paper P is pressed against the blanket roller 11 by the transfer roller 17 and hence the ink dots are transferred to the printing paper P. In this case, the amount of ink transferred from the gravure cells 18*a* onto the blanket roller 11 is expressed as a difference in size of each dot. Since this is substantially thought of as the difference of concentration, an image printed on the printing paper P exhibits faithful reproduction of the original image. After that, ink, paper powder, and others, slightly remaining on the surface of the blanket roller 11 are completely eliminated by the cleaning roller 14 through a cleaning blade and the nonwoven fabric. The surface of the blanket roller 11 is then cooled by the cooling roller 13 to provide for the next transfer of ink dots.

As will be obvious from the above description, the printer of the present invention can be constructed as a unit, and therefore, in the case of special color printing as well as of ordinary printing, desired color can be printed immediately only by replacement with a unit for exclusive use of the color. Moreover, when monochromatic units for cyan, magenta, yellow, and black are arranged in series, full color printing can be easily made. Also, color substances, such as pigment, used for such color ink are usually solidified and do not need means such as dispersing agents, and any large-specific-gravity metal of size corresponding to the gravure cell can be used. In this case, the rate of utilization of the color substance is 100%, and consumed parts to be disposed are not entirely produced.

Figure 9:
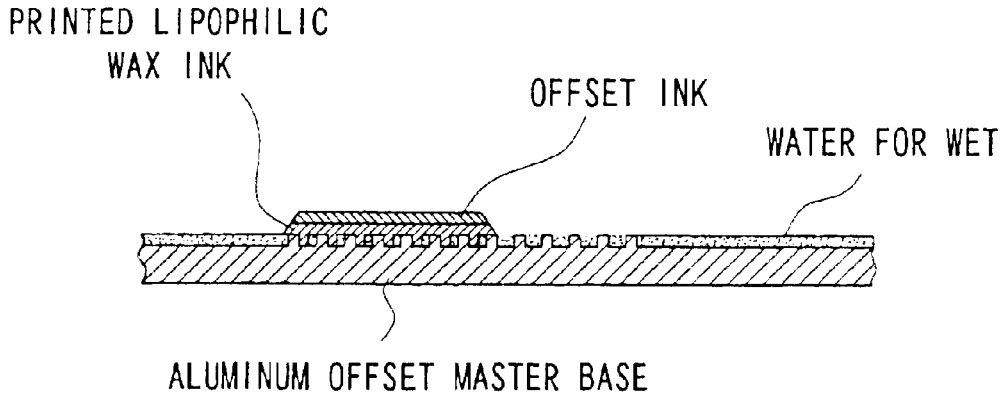
FIG. 9 is a partially enlarged sectional view showing an offset printing master printed by the printer of the present invention.

Since the blanket roller constructed of elastomer is used for transfer, its surface sufficiently accommodate matter to be printed. Thus, almost all media to be printed, such as Japanese paper, fine paper, cloth, films, glass, and disks as well as printing paper, can be used as sheets to be printed. Furthermore, it is possible to perform printing of a circuit substrate fine pattern by conductive ink, color filter direct printing, magnetic printing, T-shirt printing, and printing to textile printing transfer paper. It is also possible to easily make an offset printing master (see FIG. 9) as printing matter by imparting lipophilic to partially used wax ink. In addition, the transfer of matter to be printed is linear, and thus even though the printing matter is a solid metal plate, glass plate, ceramic plate, or plastic plate, printing is possible.

Figure 10:
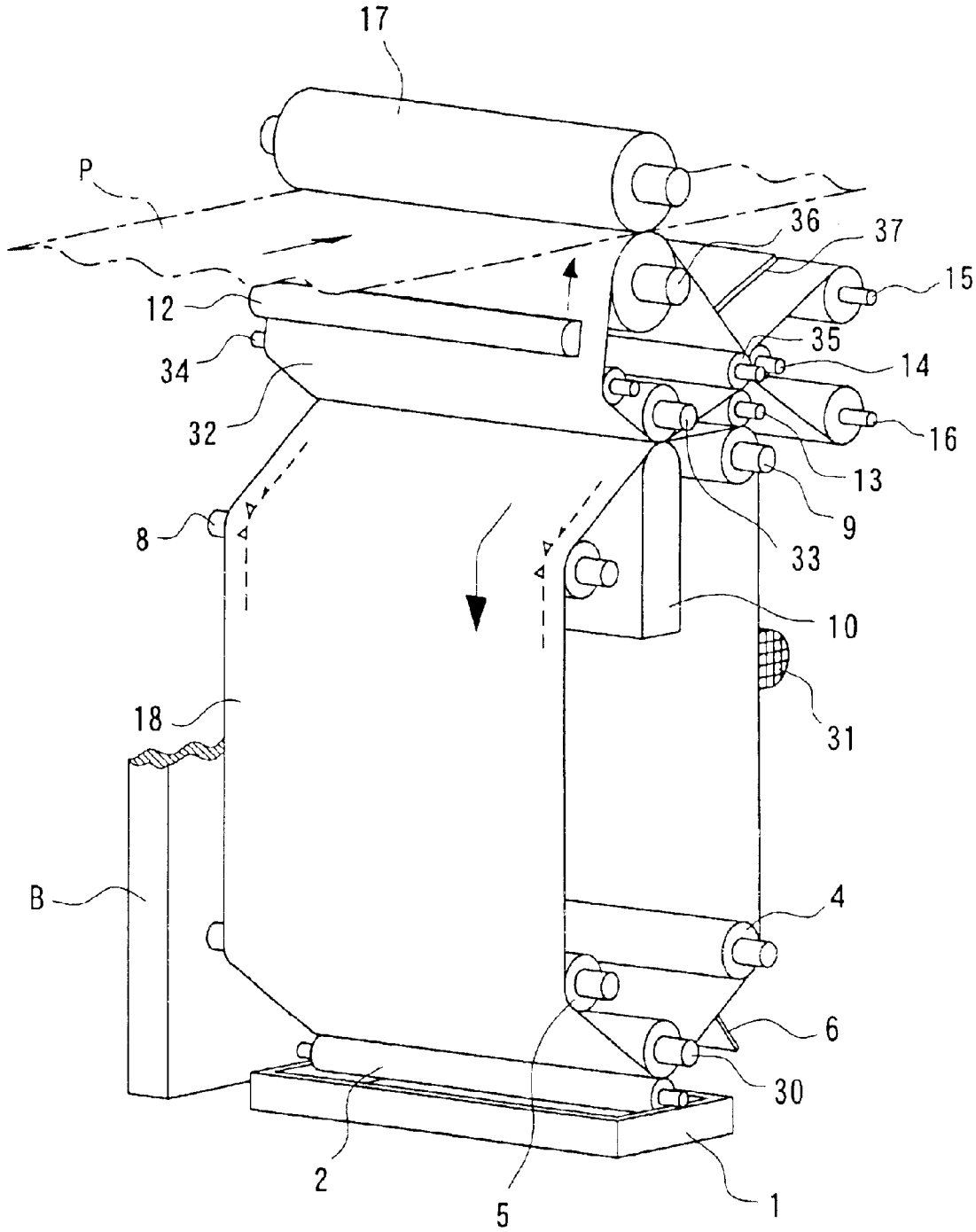
FIG. 10 is a perspective view showing the entire structure of another embodiment of the electro-thermosensitive transfer printer according to the present invention.

FIG. 10 shows another embodiment of the printer according to the present invention. In this figure, like numerals are used for substantially like members with respect to the embodiment of FIG. 1 and their detailed description is omitted. This embodiment has the same structure as the embodiment of FIG. 1 with the exception that a press roller 30 laterally mounted to be rotatable in relation to the apparatus body B is used instead of the heater head 3, a cooling fan duct 31 is used instead of the cooling roller 7, and a blanket endless belt 32 constructed of elastomer is used instead of the blanket roller 11. Specifically, the blanket endless belt 32 can be smoothly run in the direction of an arrow in such a way that predetermined tension is given by a platen roller 33 made of rubber or metal, laterally mounted to be rotatable in relation to the apparatus body B and rotated into contact with the print head 10; a pair of tension rollers 34 and 35 laterally mounted to be rotatable in relation to the apparatus body B, with the platen roller 33 between them; and a receiving roller 36. Reference numeral 37 represents a cleaning blade for scraping off ink and others remaining on the surface of the blanket endless belt 32 after the transfer of ink to the printing paper P. The cooling fan duct 31 may be replaced with the cooling roller 7.

The embodiment is constructed as mentioned above, but its function is the same as in the embodiment of FIG. 1 and thus the explanation of the function is omitted. The embodiment has the advantage of using the blanket endless belt 32, instead of the blanket roller 11, which is peculiarly suitable for the case where matter to be printed is a hard plate such as a glass plate. Moreover, the blanket endless belt 32 is lower in cost than the blanket roller 11 and hence has the advantage of being able to provide a less expensive printer.

Figure 11:
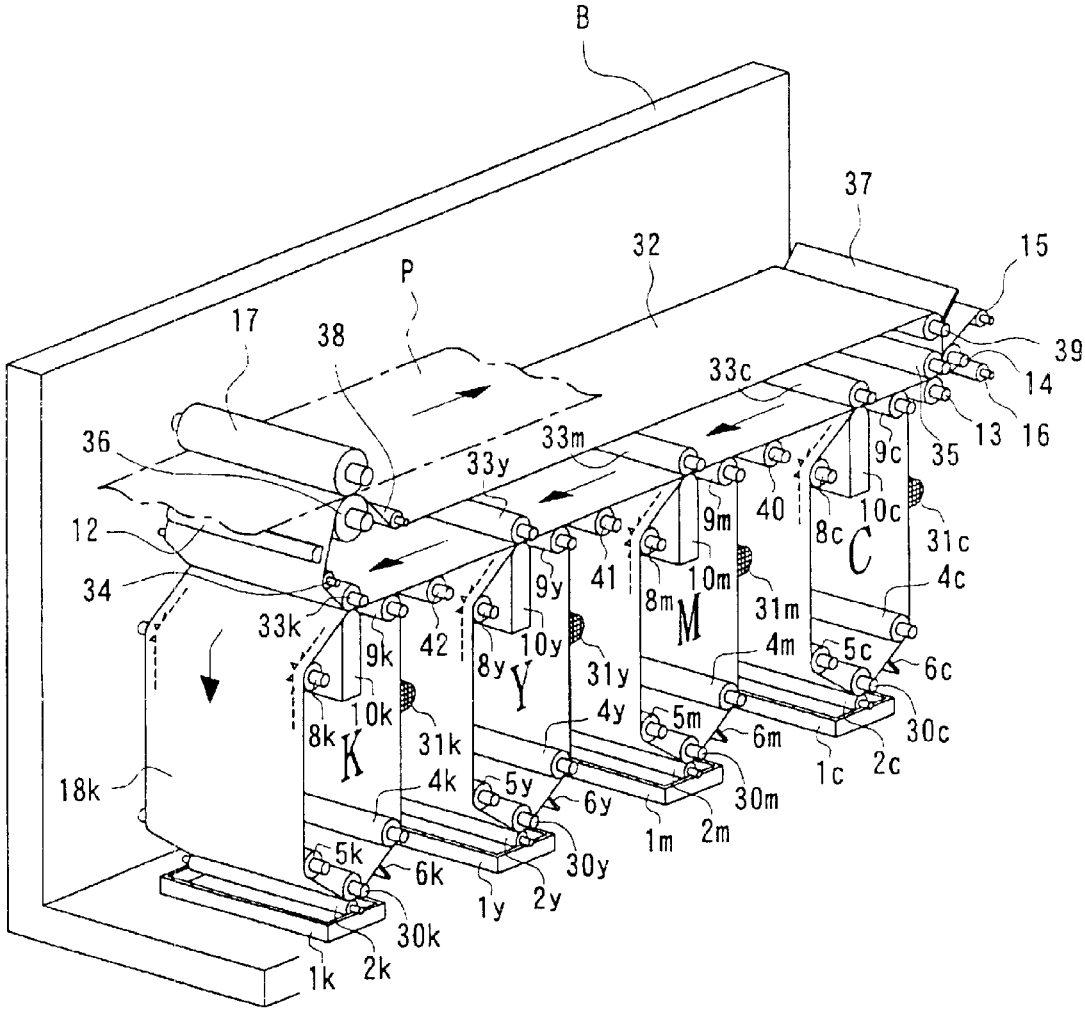
FIG. 11 is a perspective view showing the entire structure of still another embodiment of the electro-thermosensitive transfer printer according to the present invention.

FIG. 11 shows still another embodiment of the printer according to the present invention. In this figure, like numerals are used for substantially like members with respect to the embodiment of FIG. 10 and their detailed description is omitted. This embodiment has the same structure as the above embodiments with the exception that the receiving roller 36 is considerably spaced away from the tension roller 35, compared with the embodiment of FIG. 10, and a gravure endless ribbon unit C for cyan only, a gravure endless ribbon unit M for magenta only, a gravure endless ribbon unit Y for yellow only, and a gravure endless ribbon unit K for black only are arranged in this order at prescribed intervals between the rollers 35 and 36.

Specifically, in the embodiment, the blanket endless belt between the tension roller 35 and the receiving roller 36 is put so that it is run horizontally by tensions rollers 38 and 39, and cooling rollers 40, 41, and 42 are arranged, each of which is laterally mounted to be rotatable in relation to the apparatus body B and rotated into contact with the surface of the blanket endless belt 32 between adjacent gravure endless ribbon units. Since the gravure endless ribbon units C, M, Y, and K are constructed in fundamentally the same manner as that shown in FIG. 10, like numerals are used for substantially like members with respect to the members of FIG. 10 and are provided with subscripts c, m, y, and k, and their description is omitted.

The embodiment is constructed as mentioned above, and thus full color printing can be achieved surely, in safety, and at a high speed, for example, in the elongated matter P to be printed, such as a flag, and matter, such as an elongated glass plate. Since the replacement of each of the gravure endless ribbon units can be done with great ease, the downtime of the apparatus can be kept to a minimum, and a superhigh-efficiency color printer is provided. Each gravure endless ribbon unit is removed from an operation line when occasion demands, and thereby can be selectively used, and a printer for monochromatic or dichromatic color printing which is handled with great ease at the site can be provided.

In any of the above embodiments, either the cooling roller or the cooling fan can be properly used by replacement, or both can be used in combination. According to the present invention, a well-known thermal print head can be used instead of the resistive ribbon thermal print head 10, and a thermal transfer film can also be used instead of the gravure endless ribbon 18. In addition, the printer can be used as a common thermal transfer printer by a simple change in structure.

Figure 12:
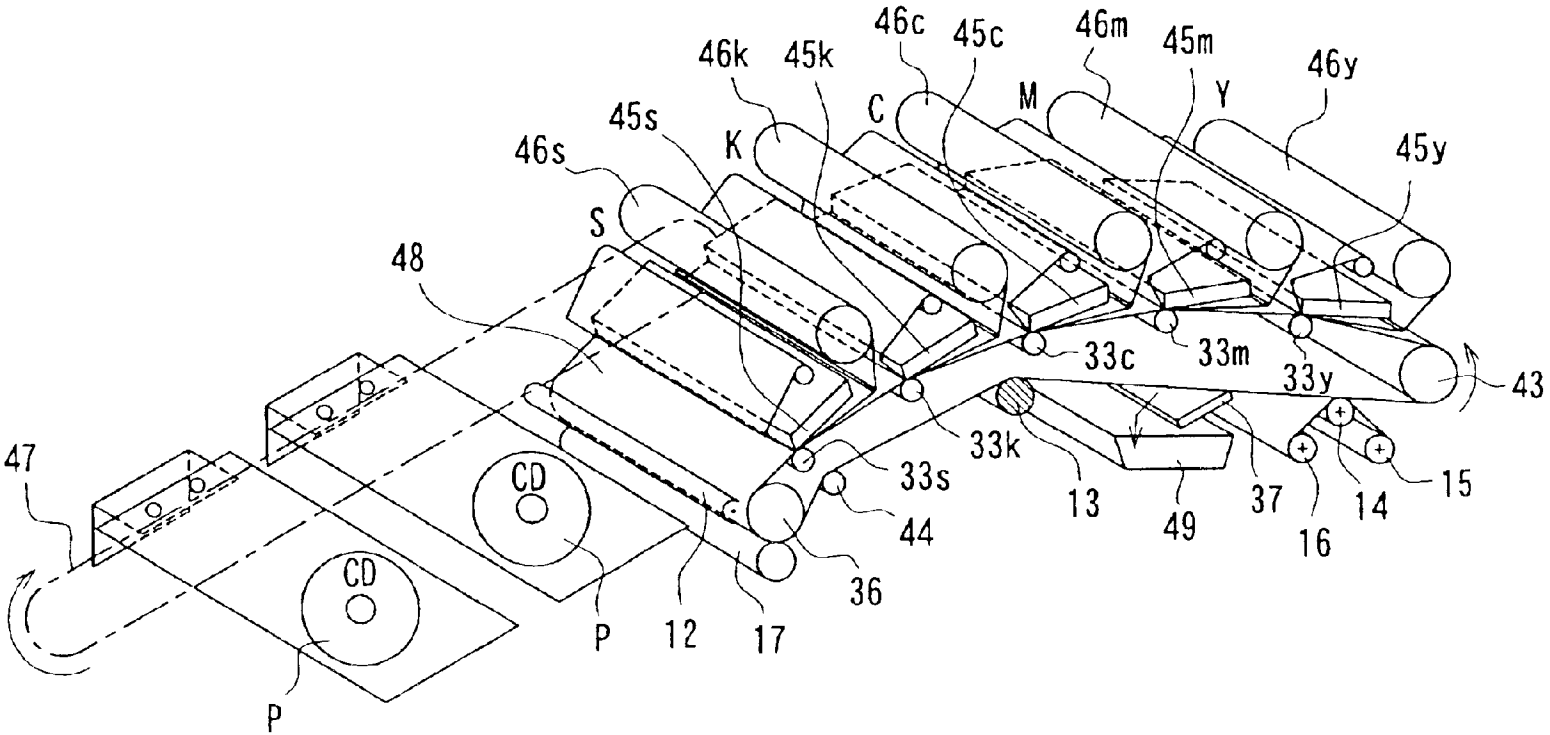
FIG. 12 is a perspective view showing the entire structure of more embodiment of the electro-thermosensitive transfer printer according to the present invention.

FIG. 12 shows one embodiment of the (electro-) thermosensitive transfer printer according to the present invention, using the well-known thermal print head instead of the resistive ribbon thermal print head 10. In this embodiment also, like numerals are used for substantially like members with respect to the above embodiments and their detailed description is omitted. In this figure, reference numeral 43 denotes a driving roller; 44 denotes a tension roller; 45*y*, 45*m*, 45*c*, 45*k*, and 45*s* denote well-known thermal print heads for yellow, magenta, cyan, black, and special color such as gold or silver, respectively; 46*y*, 46*m*, 46*c*, 46*k*, and 46*s* denote ink ribbons for yellow, magenta, cyan, black, and special color such as gold or silver, respectively, cooperating with the thermal print heads 45*y*, 45*m*, 45*c*, 45*k*, and 45*s*; 47 denotes a CD tray feed belt for inserting in turn compact disks as the printing matter P between the transfer roller (impression cylinder) 17 and the receiving roller 36, namely between the transfer roller (impression cylinder) 17 and an endless belt 48 which is an intermediate transfer member; 49 denotes a vessel receiving used ink scraped off from the surface of the endless belt 48 by the cleaning blade 37.

Each of combinations of the thermal print head 45*y* and the ink ribbon 46*y*, the thermal print head 45*m* and the ink ribbon 46*m*, the thermal print head 45*c* and the ink ribbon 46*c*, the thermal print head 45*k* and the ink ribbon 46*k*, and the thermal print head 45*s* and the ink ribbon 46*s* is constructed as a thermal printer unit having well-known structure and function and is removably placed at a preset position. The thermal print heads 45*y*, 45*m*, 45*c*, 45*k*, and 45*s* are associated with the platen rollers 33*y*, 33*m*, 33*c*, 33*k*, and 33*s*, respectively, so that characters and images of yellow, magenta, cyan, black, and special color are transferred onto the endless belt 48 and can be printed in succession directly on the surfaces of the compact disks as the printing matter P. The functions of other members are the same as in the embodiments already mentioned and thus their explanation is omitted.

Figure 13:
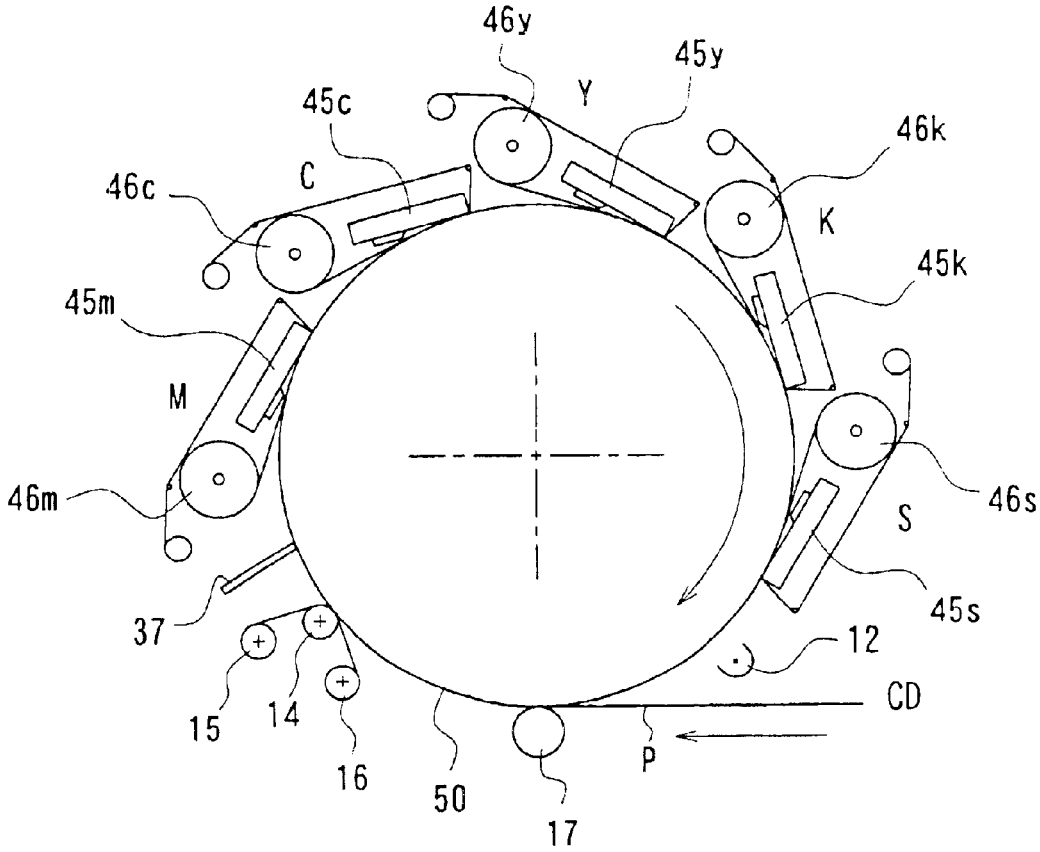
FIG. 13 is a perspective view showing the entire structure of further more embodiment of the electro-thermosensitive transfer printer according to the present invention.

FIG. 13 shows another embodiment of the (electro-) thermosensitive transfer printer according to the present invention, using the well-known thermal print head instead of the resistive ribbon thermal print head 10. In this embodiment also, like numerals are used for substantially like members with respect to the above embodiments and their detailed description is omitted. As will be obvious from the figure, the embodiment has the same structure as the embodiment of FIG. 12 with the exception that a large-diameter drum 50 is provided instead of the endless belt 48 which is the intermediate transfer member, and the thermal printer units for magenta, cyan, yellow, black, and special color are arranged in turn around the drum 50. Since the function and effect of the embodiment are substantially the same as in the embodiment of FIG. 12, their description is omitted.

Figure 14:
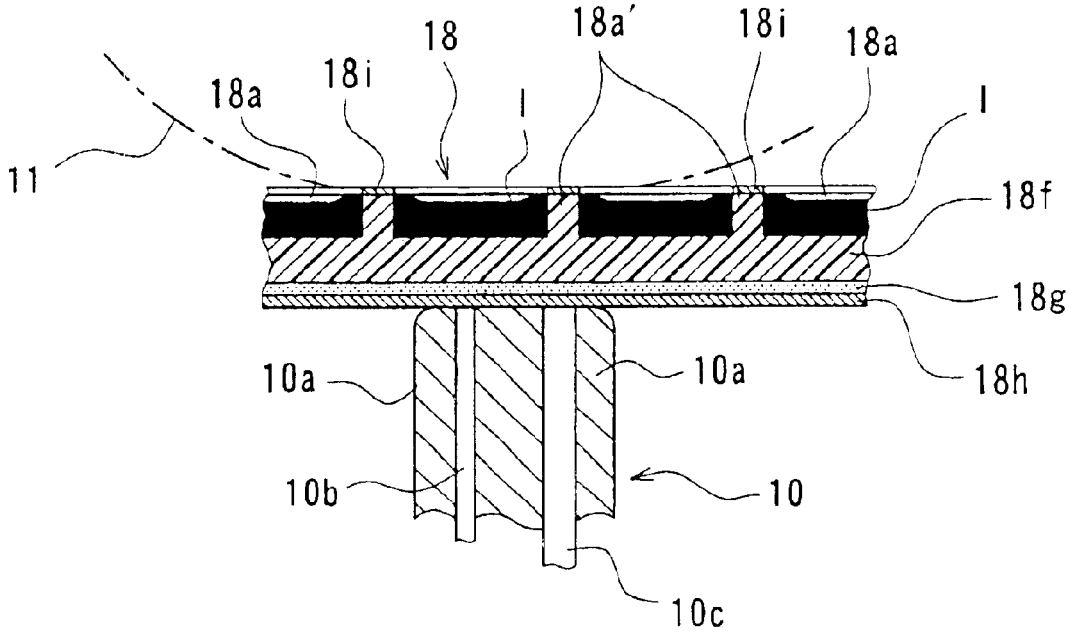
FIG. 14 is a partially enlarged sectional view showing another embodiment of the gravure endless ribbon, shown as in FIG. 4.

FIG. 14 shows another embodiment of the gravure endless ribbon 18, shown as in FIG. 4. In this figure, like numerals are used for substantially like members and parts with respect to FIG. 4. This embodiment has the same structure as the embodiment of FIG. 4 with the exception that a conductive thin film belt 18*f* having the gravure cells 18*a* is made of heat-resistant polymer resin of low thermal conductivity, such as aromatic polyamide, polybenzimidazole, fluororesin, or polyimide, a base electrode layer 18*g* of aluminum is evaporated on the back side of the conductive thin film belt 18*f*, a high abrasion-resistant conductive film layer 18*h* such as diamond-like carbon (DLC) is provided thereon, and a high abrasion-resistant conductive film 18*i* such as diamond-like carbon is also provided on the right side of the conductive thin film belt 18*f*.

The function of the gravure endless ribbon 18 in the embodiment is fundamentally the same as those already mentioned and thus its description is omitted. However, since the heat-resistant polymer resin of low thermal conductivity is used for the conductive thin film belt 18*f*, heat generated by energizing the print head 10 is hard to escape and there is little difference in thermal conductivity between the ink I the gravure cells 18*a* and the conductive thin film belt 18*f*. As such, this heat is effectively transmitted to the ink I in the gravure cells 18*a* and a higher tone production of a print image becomes possible. High abrasion-resistant materials such as diamond-like carbon are used for the conductive films 18*h* and 18*i*, and hence even when the doctor blade 6 is applied, the gravure cells 18*a* will not be damaged. Moreover, the belt 18*f* is little worn by sliding contact of the print head 10. Thus, a gravure endless ribbon withstanding long-continued use can be provided.

What is claimed is:

1. A resistive ribbon thermal print head comprising:

an electric insulating plate body having a top face of a predetermined width;

a heat-radiating plate of a predetermined thickness, embedded in said electric insulating plate body and having a top face exposed on the top face of said electric insulating plate body; and a large number of signal electrodes arranged at prescribed intervals, embedded in said electric insulating plate body along said heat-radiating plate at a given distance away from said heat-radiating plate and having top faces exposed on the top face of said electric insulating plate body.

2. A resistive ribbon thermal print head according to claim 1, wherein said electric insulating plate body is made of resin of low frictional resistance, poor heat conductivity, and good electric insulation, such as polytetrafluoroethylene, polyethylene, polyacetals, or polypropylene, or ceramic; said heat-radiating plate is made of metal of good heat conductivity, such as copper, aluminum, or silver, or diamond or ceramic equivalent thereto; and said signal electrodes are made of metal, such as tungsten or tantalum.

3. An electro-thermosensitive transfer printer comprising:

a gravure endless ribbon including:

a conductive thin film belt having a large number of partition walls arrayed in a lattice manner on a surface thereof in order to define a large number of gravure cells of predetermined size; and an electric resistor layer laminated on a back side of said conductive thin film belt; and a resistive ribbon thermal print head including:

an electric insulating plate body having a top face to come into contact with said electric resistor layer of said gravure endless ribbon;

a heat-radiating plate embedded in said electric insulating plate body so that a top face thereof slides along a surface of said electric resistor layer, having a thickness corresponding to a thickness of each of said partition walls; and a large number of signal electrodes embedded in said electric insulating plate body so that each of top faces thereof is substantially spaced from said heat-radiating plate by a distance corresponding to a half of a size of each of said gravure cells and is opposite thereto to slide along the surface of said electric resistor layer, said signal electrodes being arrayed to be opposite to said gravure cells in front of said heat-radiating plate with respect to a running direction of said gravure endless ribbon.

4. An electro-thermosensitive transfer printer comprising:

a gravure endless ribbon including:

a heat-resistant polymer resin thin film belt having partition walls arrayed in a lattice manner on a surface thereof in order to define a large number of gravure cells of predetermined size;

a base electrode layer evaporated on a back side of said thin film belt;

a first conductive film provided on said base electrode layer; and a second conductive film provided on a right side of said thin film belt; and a resistive ribbon thermal print head including:

an electric insulating plate body having a top face to come into contact with a surface of said first conductive film of said gravure endless ribbon;

a heat-radiating plate embedded in said electric insulating plate body so that a top face thereof slides along the surface of said first conductive film, having a thickness corresponding to a thickness of each of said partition walls; and a large number of signal electrodes embedded in said electric insulating plate body so that each of top faces thereof is substantially spaced from said heat-radiating plate by a distance corresponding to a half of a size of each of said gravure cells and is opposite thereto to slide along the surface of said first conductive film, said signal electrodes being arrayed to be opposite to said gravure cells in front of said heat-radiating plate with respect to a running direction of said gravure endless ribbon.

5. An electro-thermosensitive transfer printer according to claim 4, wherein said heat-resistant resin thin film belt is made of aromatic polyamide, polybenzimidazole, fluororesin, or polyimide; said base electrode layer is made of aluminum, and said first conductive film and said second conductive film are made of diamond-like carbon.

6. An electro-thermosensitive transfer printer comprising:

an ink tank having a heating device;

an ink supply roller partially immersed in said ink tank and rotated;

a pair of tension rollers, a press roller, and a sprocket, arranged at prescribed intervals;

a thermal transfer film tightened to be able to run via said pair of tension rollers, said press roller, and said sprocket so that a right side thereof comes into contact with said ink supply roller, or a gravure endless ribbon of a predetermined width, having an electric resistor layer on a back side of a conductive thin film belt which is provided with a large number of gravure cells arrayed in a lattice manner on a right side thereof;

a first cooling fan placed in the proximity of said thermal transfer film or said gravure endless ribbon, or a first cooling roller laterally mounted to rotate into contact with a back side of said thermal transfer film or said gravure endless ribbon;

a resistive ribbon thermal print head including an electric insulating plate body having a top face of a predetermined width; a heat-radiating plate of a predetermined thickness, embedded in said electric insulating plate body and having a top face exposed on the top face of said electric insulating plate body; and a large number of signal electrodes arranged at prescribed intervals, embedded in said electric insulating plate body along said heat-radiating plate at a given distance away from said heat-radiating plate and having top faces exposed on the top face of said electric insulating plate body; and interposed between said press roller and said sprocket so that top faces of said heat-radiating plate and said large number of signal electrodes slide along the back side of said thermal transfer film or said gravure endless ribbon;

a blanket roller laterally mounted to rotate into contact with said gravure endless ribbon put between said blanket roller and said resistive ribbon thermal print head and between said blanket roller and said press roller;

a transfer roller (impression cylinder) mounted to rotate into contact with matter to be printed, put between said transfer roller and said blanket roller;

a heater mounted close to said blanket roller in front of said blanket roller; and a second cooling fan placed close to said blanket roller behind said blanket roller, or a second cooling roller mounted to rotate into contact with said blanket roller, said first cooling roller and said second cooling roller being constructed with heat pipes.

7. An electro-thermosensitive transfer printer according to claim 6, further comprising a heater mounted in the proximity of the back side of said gravure endless ribbon between said pair of tension rollers; a doctor blade mounted so as to come into contact with the right side of said gravure endless ribbon behind said ink supply roller; and a cleaning roller mounted so that a nonwoven fabric belt is run into contact with said blanket roller between said transfer roller (impression cylinder) and said second cooling roller.

8. An electro-thermosensitive transfer printer comprising:

an ink tank;

an ink supply roller partially immersed in said ink tank and rotated;

a pair of tension rollers, a press roller, and a sprocket, arranged at prescribed intervals;

a thermal transfer film tightened to be able to run via said pair of tension rollers, said press roller, and said sprocket so that a right side thereof comes into contact with said ink supply roller, or a gravure endless ribbon of a predetermined width having an electric resistor layer on a back side of a conductive thin film belt which is provided with a large number of gravure cells arrayed in a lattice manner on a right side thereof;

a first cooling roller mounted to rotate into contact with a back side of said thermal transfer film or said gravure endless ribbon, or a first cooling fan placed in the proximity of the back side of said thermal transfer film or said gravure endless ribbon;

a thermal print head interposed between said press roller and said sprocket to slide along the back side of said thermal transfer film or said gravure endless ribbon, or a resistive ribbon thermal print head including an electric insulating plate body having a top face of a predetermined width; a heat-radiating plate of a predetermined thickness, embedded in said electric insulating plate body and having a top face exposed on the top face of said electric insulating plate body; and a large number of signal electrodes arranged at prescribed intervals, embedded in said electric insulating plate body along said heat-radiating plate at a given distance away from said heat-radiating plate and having top faces exposed on the top face of said electric insulating plate body; and provided so that top faces of said heat-radiating plate and said large number of signal electrodes slide along the back side of said gravure endless ribbon;

a platen roller mounted to rotate into contact with said thermal print head or said resistive ribbon thermal print head;

a receiving roller mounted to be rotatable in parallel with said platen roller;

a blanket endless belt put via said receiving roller and said platen roller so as to maintain predetermined tension and run so as to press a surface of said gravure endless ribbon put between said blanket endless belt and said thermal print head or said resistive ribbon thermal print head;

a transfer roller (impression cylinder) mounted to rotate into contact with matter to be printed, put between said transfer roller and said blanket endless belt;

a heater laterally mounted close to said blanket endless belt in front of said transfer roller (impression cylinder); and a second cooling roller mounted to rotate into contact with said blanket endless belt behind said transfer roller (impression cylinder), or a second cooling fan mounted close to the surface of said gravure endless ribbon, a first cooling roller and said second cooling rollers being constructed with heat pipes.

9. An electro-thermosensitive transfer printer according to claim 8, further comprising a second press roller provided between said pair of tension rollers to press the surface of said gravure endless ribbon against said ink supply roller; a doctor blade mounted so as to come into contact with the surface of said gravure endless ribbon behind said ink supply roller; and a cleaning blade mounted so as to slide along the surface of said blanket endless ribbon between said transfer roller (impression cylinder) and said second cooling roller or a second cooling fan and a cleaning roller mounted so as to run a nonwoven fabric belt into contact with the surface of said blanket endless belt.

10. An electro-thermosensitive transfer printer according to any one of claims 6-9, further comprising a memory means detecting an electric resistance value between each of said gravure cells and a corresponding signal electrode, with each of a large number of signal electrodes as a probe, to record said resistance value and an address of each of said gravure cells; and an electric control means calculating electric energy to be supplied to each of said signal electrodes from image data, the address of each of said gravure cells recorded in said memory means, and a corresponding resistance value during run of said gravure endless ribbon.

11. An electro-thermosensitive transfer printer according to any one of claims 6-9, wherein ink stored said ink tank is changed into lipophilic wax ink, and said matter to be printed can be used as an offset printing master whose surface to be printed becomes rough.

12. An electro-thermosensitive transfer printer comprising a plurality of thermal transfer film units or a plurality of gravure endless ribbon units, said plurality of thermal transfer film units or said plurality of gravure endless ribbon units including:

pairs of tension rollers nearly horizontally arranged to be rotatable at prescribed intervals;

a receiving roller rotatably placed between a pair of tension rollers arranged on one end side;

a transfer roller (impression cylinder) placed to rotate into contact with said receiving roller;

a plurality of platen rollers arranged on a substantially the same horizontal plane to be rotatable at prescribed intervals between said pair of tension rollers arranged on one end side and a pair of tension rollers arranged on a remaining end side;

a blanket endless belt tightened by said tension rollers, said receiving roller, and said platen rollers;

a heater mounted in the proximity of a surface of said blanket endless belt in front of said receiving roller or said tension rollers;

a cleaning blade mounted to slide along the surface of said blanket endless belt behind said receiving roller; and cooling rollers mounted to rotate into contact with the surface of said blanket endless belt behind said platen rollers or cooling fans arranged in the proximity of the surface, each of said plurality of thermal transfer film units or said plurality of gravure endless ribbon units including:

an ink tank;

an ink supply roller partially immersed in said ink tank and rotated;

a pair of tension rollers, a press roller, and a sprocket, arranged at prescribed intervals;

a thermal transfer film tightened to be able to run via said pair of tension rollers, said press roller, and said sprocket so that a right side thereof comes into contact with said ink supply roller, or a gravure endless ribbon of a predetermined width, having a conductive thin film belt provided with a large number of gravure cells arrayed in a lattice manner on a right side thereof and an electric resistor layer on a back side thereof or a heat-resistant polymer resin thin film belt provided with a large number of gravure cells arrayed in a lattice manner, with a conductive layer on a right side thereof, and a base electrode layer and a conductive film layer on a back side thereof;

a first cooling roller mounted to rotate into contact with the back side of said thermal transfer film or said gravure endless ribbon, or a cooling fan placed in the proximity of the back side; and a thermal print head interposed between said press roller and said sprocket to slide along the back side of said gravure endless ribbon or said thermal transfer film, or a resistive ribbon thermal print head including an electric insulating plate body having a top face of a predetermined width; a heat-radiating plate of a predetermined thickness, embedded in said electric insulating plate body and having a top face exposed on the top face of said electric insulating plate body; and a large number of signal electrodes arranged at prescribed intervals, embedded in said electric insulating plate body along said heat-radiating plate at a given distance away from said heat-radiating plate and having top faces exposed on the top face of said electric insulating plate body; and provided so that top faces of said heat-radiating plate and said large number of signal electrodes slide along the back side of said gravure endless ribbon, each of said thermal transfer film units or each of said gravure endless ribbon units being removably constructed so that said thermal print head or said resistive ribbon thermal print head presses said thermal transfer film or said gravure endless ribbon put between said and each of said platen rollers against each of said platen rollers.

13. An electro-thermosensitive transfer printer according to any one of claims 6-9 or 12, wherein said heat-resistant resin thin film belt is made of aromatic polyamide, polybenzimidazole, fluororesin, or polyimide; said base electrode layer is made of aluminum; and said first conductive film and said second conductive film are made of diamond-like carbon.

14. An electro-thermosensitive transfer printer comprising a blanket endless belt unit including:

a plurality of platen rollers arranged at prescribed intervals;

a receiving roller placed parallel with said platen rollers;

a transfer roller (impression cylinder) rotated into contact said the receiving roller; and a blanket endless belt tightened by said plurality of platen rollers and said receiving roller and run between said receiving roller and said transfer roller (impression cylinder), and a plurality of gravure endless ribbon units or a plurality of thermal transfer film units, each including:

an ink supply roller;

a plurality of second tension rollers;

a thermal print head or a resistive ribbon thermal print head; and a gravure endless ribbon or a thermal transfer film tightened by said ink supply roller and said plurality of second tension rollers, each of said thermal transfer film units or each of said gravure endless ribbon units being removably constructed so that said thermal print head or said resistive ribbon thermal print head presses said thermal transfer film or said gravure endless ribbon put between said print head and each of said platen rollers against each of said platen rollers.

15. An electro-thermosensitive transfer printer according to claim 12 or 14, wherein said plurality of gravure endless ribbon units or said plurality thermal transfer film units include a proper combination selected from a unit for cyan only, a unit for magenta only, a unit for yellow only, a unit for black only, and a unit for special color only, such as gold or silver.

16. An electro-thermosensitive transfer printer according to claim 12 or 14, wherein said printer further comprises a cleaning roller mounted so that a nonwoven fabric belt runs into contact with the surface of said gravure endless ribbon in front of said cleaning blade, and each of said gravure endless ribbon units further includes a press roller pressing the surface of said gravure endless ribbon against said ink supply roller and a heater placed in the proximity of said gravure endless ribbon behind said press roll.

17. An electro-thermosensitive transfer printer comprising a plurality of thermal printer units arranged at prescribed intervals, each having a thermal print head and an ink ribbon pressed against a transfer surface by said thermal print head, along said transfer surface of an intermediate transfer member capable of running, and an impression cylinder placed in front of said thermal printer units, pressing matter to be printed against said transfer surface, wherein a thermal printer unit for cyan only, a thermal printer unit for magenta only, a thermal printer unit for yellow only, a thermal printer unit for black only, and a thermal printer unit for special color only, such as gold or silver, are removably arranged at prescribed intervals along said transfer surface.

18. An electro-thermosensitive transfer printer comprising a plurality of thermal printer units arranged at prescribed intervals, each having a thermal print head and an ink ribbon pressed against a transfer surface by said thermal print head, along said transfer surface of an intermediate transfer member capable of running, and an impression cylinder placed in front of said thermal printer units, pressing matter to be printed against said transfer surface, wherein a thermal printer unit for cyan only, a thermal printer unit for magenta only, a thermal printer unit for yellow only, a thermal printer unit for black only, and a thermal printer unit for special color only, such as gold or silver, are removably arranged at prescribed intervals along said transfer surface, wherein said intermediate transfer member has a shape of an endless belt or a drum.

* * * * *